US012808275B2

(12) United States Patent
Roesner et al.

(10) Patent No.: US 12,808,275 B2
(45) Date of Patent: Nov. 24, 2026

(54) FLUID CONDUIT ASSEMBLY FOR A FLUID SUPPLY SYSTEM

(71) Applicant: Scout Surface Solutions, LLC, Joshua, TX (US)

(72) Inventors: Thomas George Roesner, Cypress, TX (US); David Lane Evans, Conroe, TX (US)

(73) Assignee: Scout Surface Solutions, LLC, Joshua, TX (US)

( * ) Notice: Subject to any disclaimer, the term of this patent is extended or adjusted under 35 U.S.C. 154(b) by 0 days.

(21) Appl. No.: 19/173,366

(22) Filed: Apr. 8, 2025

(65) Prior Publication Data

US 2025/0297524 A1 Sep. 25, 2025

Related U.S. Application Data

(63) Continuation of application No. 17/952,425, filed on Sep. 26, 2022, now Pat. No. 12,270,271.

(60) Provisional application No. 63/248,508, filed on Sep. 26, 2021.

(51) Int. Cl.
*E21B 33/068* (2006.01)
*E21B 34/02* (2006.01)

(52) U.S. Cl.
CPC ..... *E21B 33/068* (2013.01); *E21B 34/025* (2020.05)

(58) Field of Classification Search
CPC ..... E21B 33/068; E21B 34/025
See application file for complete search history.

(56) References Cited

U.S. PATENT DOCUMENTS

| | | | | |
|---|---|---|---|---|
| 9,995,102 | B2 | 6/2018 | Dille et al. | |
| 10,436,368 | B2 | 10/2019 | Kajaria et al. | |
| 10,808,512 | B2 * | 10/2020 | Koricanek | E21B 43/2607 |
| 10,975,677 | B2 * | 4/2021 | Shampine | E21B 43/261 |
| 2017/0122060 | A1 * | 5/2017 | Dille | E21B 43/2607 |
| 2017/0268306 | A1 * | 9/2017 | Kajaria | B60P 3/2265 |
| 2018/0187508 | A1 | 7/2018 | Roesner et al. | |

(Continued)

OTHER PUBLICATIONS

TechnipFMC, Flowline products and services, 2018, 92 pgs.

(Continued)

*Primary Examiner* — Tara Schimpf
*Assistant Examiner* — Patrick F Lambe
(74) *Attorney, Agent, or Firm* — Fletcher Yoder, P.C.

(57) ABSTRACT

A fluid conduit assembly for a fluid supply system includes a low-pressure monobore conduit assembly having a low-pressure monobore conduit and low-pressure outlets. The low-pressure outlets are configured to direct low-pressure fluid from the low-pressure monobore conduit to pumps. At least one first low-pressure outlet is positioned on a first side of the low-pressure monobore conduit, and at least one second low-pressure outlet is positioned on a second side of the low-pressure monobore conduit. The fluid conduit assembly includes a high-pressure monobore conduit assembly having a high-pressure monobore conduit and high-pressure inlets. The high-pressure inlets are configured to direct high-pressure fluid from the pumps to the high-pressure monobore conduit. At least one first high-pressure inlet is positioned on a first side of the high-pressure monobore conduit, and at least one second high-pressure inlet is positioned on a second side of the high-pressure monobore conduit.

20 Claims, 7 Drawing Sheets

(56) References Cited

U.S. PATENT DOCUMENTS

| | | | | |
|---|---|---|---|---|
| 2020/0149362 | A1* | 5/2020 | Terwilliger | E21B 21/10 |
| 2023/0119473 | A1 | 4/2023 | Roesner et al. | |

OTHER PUBLICATIONS

TechnipFMC, iComplete Frac different: Faster. Safer. Smarter., 2020, 9 pgs.
FET, Manifold Trailers, 2024, 2 pgs, https://f-e-t.com/stimulation/manifold-trailers/.
TSI Flow Products, BFS Manifold Skids, 2024, 10 pgs, https://www.tsiflowproducts.com/frac-flowback/missile-skids.
WEIR, SPM Flow Control Product Catalog, Feb. 24, 2020, 64 pgs.
WEIR, Oil & Gas Simplified Frac Iron System, 2018, 12 pgs.

* cited by examiner

FLUID CONDUIT ASSEMBLY FOR A FLUID SUPPLY SYSTEM

CROSS-REFERENCE TO RELATED APPLICATION

This application claims priority from and the benefit of U.S. Provisional Application Ser. No. 63/248,508, entitled "FLUID CONDUIT ASSEMBLY FOR A FLUID SUPPLY SYSTEM", filed Sep. 26, 2021, which is hereby incorporated by reference in its entirety.

BACKGROUND

The present disclosure relates generally to a fluid conduit assembly for a fluid supply system.

Various resources (e.g., hydrocarbon gas, oil, etc.) may be extracted from subterranean formations by drilling wells into the subterranean formations. During production, one or more resources may flow from the subterranean formation to a wellhead via the well. The wellhead may include components (e.g., valves, connectors, etc.) configured to control flow of the one or more resources to storage and/or processing assemblies.

For a subterranean formation having low porosity and/or low permeability, and/or when flow of the one or more resources from a subterranean formation decreases, a well stimulation system may be employed to perform a well stimulation operation to fracture the subterranean formation, thereby increasing the flow of the one or more resources from the subterranean formation. The well stimulation system typically includes a well stimulation fluid supply system and a well stimulation tree. The well stimulation fluid supply system includes a fluid source configured to output fracturing fluid (e.g., including water, sand, proppant, acid, chemicals, additives, etc.) and one or more pumps configured to significantly increase the pressure of the fracturing fluid. The well stimulation fluid supply system is configured to output the high-pressure fracturing fluid to the well stimulation tree. The well stimulation tree is coupled to the wellhead and configured to direct the high-pressure fracturing fluid through the wellhead and the well to the subterranean formation.

Certain well stimulation fluid supply systems include a fluid conduit assembly having multiple low-pressure conduits and a high-pressure conduit. The low-pressure conduits may be disposed on opposite lateral sides of the high-pressure conduit, and the low-pressure conduits may be fluidly coupled to an inlet manifold. The inlet manifold may be configured to receive the fracturing fluid from the fluid source and to provide the fracturing fluid to the low-pressure conduits. One or more low-pressure conduits positioned on a first lateral side of the high-pressure conduit may provide the fracturing fluid to a first set of pumps on the first lateral side of the high-pressure conduit, and one or more low-pressure conduits positioned on a second lateral side of the high-pressure conduit may provide the fracturing fluid to a second set of pumps on the second lateral side of the high-pressure conduit. The pumps may significantly increase the pressure of the fracturing fluid and output the high-pressure fracturing fluid to the high-pressure conduit. The high-pressure conduit, in turn, may output the high-pressure fracturing fluid to the well stimulation tree.

BRIEF DESCRIPTION

In certain embodiments, a fluid conduit assembly for a well stimulation fluid supply system includes a low-pressure monobore conduit assembly having a low-pressure monobore conduit, at least one low-pressure inlet, and multiple low-pressure outlets. The at least one low-pressure inlet is configured to direct low-pressure fluid from a fluid source to the low-pressure monobore conduit, and the low-pressure outlets are configured to direct the low-pressure fluid from the low-pressure monobore conduit to fluid pumps. At least one first low-pressure outlet is positioned on a first side of the low-pressure monobore conduit, and at least one second low-pressure outlet is positioned on a second side of the low-pressure monobore conduit, opposite the first side of the low-pressure monobore conduit. The fluid conduit assembly also includes a high-pressure monobore conduit assembly having a high-pressure monobore conduit, multiple high-pressure inlets, and at least one high-pressure outlet. The high-pressure inlets are configured to direct high-pressure fluid from the fluid pumps to the high-pressure monobore conduit, and the at least one high-pressure outlet is configured to direct the high-pressure fluid toward a well. At least one first high-pressure inlet is positioned on a first side of the high-pressure monobore conduit, and at least one second high-pressure inlet is positioned on a second side of the high-pressure monobore conduit, opposite the first side of the high-pressure monobore conduit.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Figure 1:
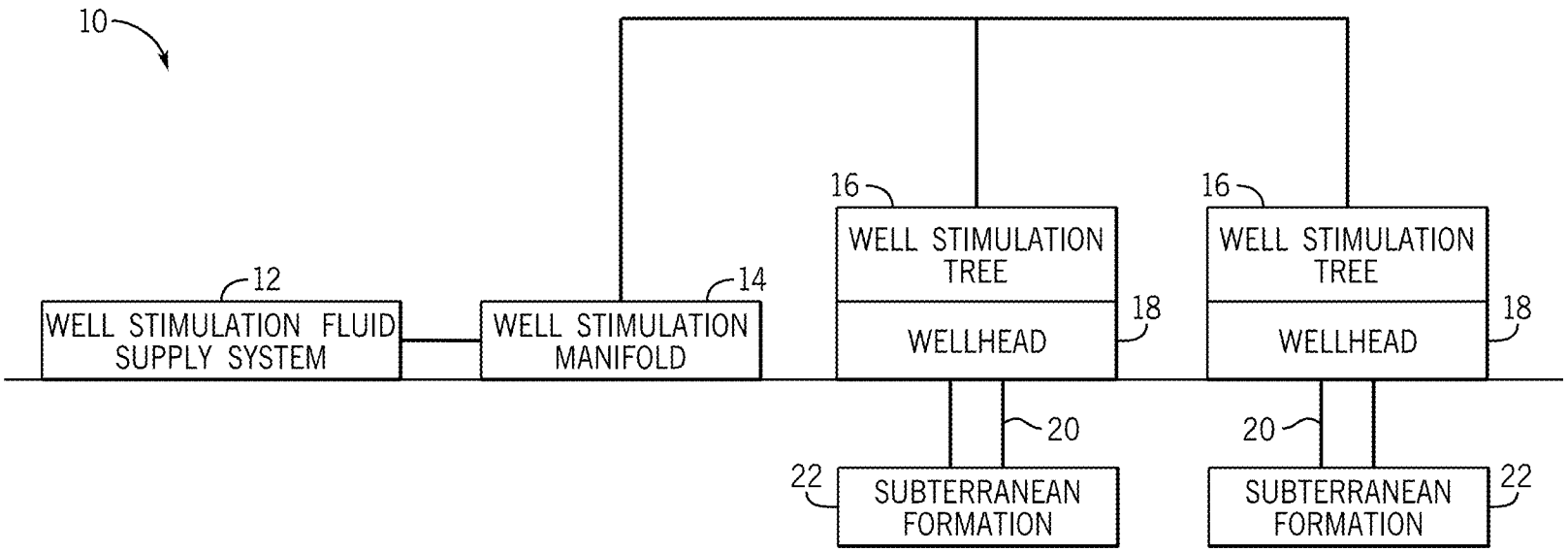
FIG. 1 is a block diagram of an embodiment of a well stimulation system.

FIG. 1 is a block diagram of an embodiment of a well stimulation system 10. In the illustrated embodiment, the well stimulation system 10 includes a well stimulation fluid supply system 12, a well stimulation manifold 14, and two well stimulation trees 16. The well stimulation fluid supply system 12 is configured to provide high-pressure fracturing fluid to the well stimulation manifold 14, and the well stimulation manifold 14, in turn, is configured to provide the high-pressure fracturing fluid to the well stimulation trees 16. As illustrated, each well stimulation tree 16 is coupled to a respective wellhead 18, and each well stimulation tree 16 is configured to direct the high-pressure fracturing fluid through the respective wellhead 18 and a respective well 20 to a respective subterranean formation 22. The high-pressure fracturing fluid may fracture the subterranean formation 22 (e.g., by increasing the size of natural fractures, by forming new fractures, etc.). As a result, the production of resources (e.g., hydrocarbon gas, oil, etc.) from the subterranean formation may be increased.

In the illustrated embodiment, the well stimulation system 10 includes two well stimulation trees 16 fluidly coupled to the well stimulation manifold 14. However, in other embodiments, the well stimulation system 10 may include more or fewer well stimulation trees (e.g., 1, 3, 4, or more) fluidly coupled to the well stimulation manifold. In addition, while the well stimulation system 10 includes a single well stimulation manifold 14 in the illustrated embodiment, in other embodiments, the well stimulation system may include additional well stimulation manifolds (e.g., in which each well stimulation manifold is fluidly coupled to one or more well stimulation trees). Furthermore, in certain embodiments, the well stimulation manifold may be omitted, and the well stimulation fluid supply system may be directly fluidly coupled to a single well stimulation tree. In embodiments having multiple well stimulation trees and no well stimulation manifold, the well stimulation fluid supply system may be fluidly coupled to each well stimulation tree individually in a cyclical/repeating pattern.

In certain embodiments, the well stimulation fluid supply 12 includes a fluid source, fluid pumps, and a fluid conduit assembly. The fluid source is configured to output low-pressure fracturing fluid to the fluid conduit assembly, and the fluid conduit assembly is configured to provide the low-pressure fracturing fluid to the fluid pumps. The fluid pumps are configured to significantly increase the pressure and, in certain embodiments flow rate, of the fracturing fluid and to provide the high-pressure fracturing fluid to the fluid conduit assembly. In addition, the fluid conduit assembly is configured to provide the high-pressure fracturing fluid to the well stimulation manifold(s).

In certain embodiments, the fluid conduit assembly includes a low-pressure monobore conduit assembly and a high-pressure monobore conduit assembly. The low-pressure monobore conduit assembly includes a low-pressure monobore conduit, one or more low-pressure inlets, and multiple low-pressure outlets. The one or more low-pressure inlets are configured to direct the low-pressure fluid (e.g., low-pressure fracturing fluid) from the fluid source to the low-pressure monobore conduit, and the low-pressure outlets are configured to direct the low-pressure fluid from the monobore conduit to the fluid pumps. In certain embodiments, at least one first low-pressure outlet is positioned on a first lateral side of the low-pressure monobore conduit, and at least one second low-pressure outlet is positioned on a second lateral side of the low-pressure monobore conduit, opposite the first lateral side. In addition, the high-pressure monobore conduit assembly includes a high-pressure monobore conduit, multiple high-pressure inlets, and one or more high-pressure outlets. The high-pressure inlets are configured to direct the high-pressure fluid from the fluid pumps to the high-pressure monobore conduit, and the one or more high-pressure outlets are configured to direct the high-pressure fluid toward the well (e.g., via the well stimulation manifold and the well stimulation tree). In certain embodiments, at least one first high-pressure inlet is positioned on a first lateral side of the high-pressure monobore conduit, and at least one second high-pressure inlet is positioned on a second lateral side of the high-pressure monobore conduit, opposite the first lateral side. Because the low-pressure outlets are disposed on both lateral sides of the low-pressure monobore conduit, and the high-pressure inlets are disposed on both lateral sides of the high-pressure monobore conduit, fluid pumps may be disposed on both lateral sides of the fluid conduit assembly, thereby reducing the length and width of the well stimulation fluid supply system (e.g., as compared to a fluid conduit assembly having low-pressure outlets on one side of a low-pressure conduit and/or high-pressure inlets on one side of a high-pressure conduit). In addition, because the fluid conduit assembly has a single low-pressure conduit and a single high-pressure conduit, the cost of fabrication, installation, operation, and product life-cycle management of the fluid conduit assembly may be significantly reduced (e.g., as compared to a fluid conduit assembly having one or more low-pressure conduits on each lateral side of a high-pressure conduit).

While the fluid conduit assembly is disclosed herein with regard to a well stimulation system (e.g., as an element of a well stimulation fluid supply system), the fluid conduit assembly, as described herein, may also be employed within any other suitable system configured to provide fluid to a well. For example, in certain embodiments, the fluid conduit assembly may be employed within a well intervention fluid supply system of a well intervention system. The well intervention system may provide intervention fluid (e.g., including water, acid, sand, proppant, etc.) to a well to further fracture the subterranean formation, thereby increasing production of resources from the well.

Figure 2:
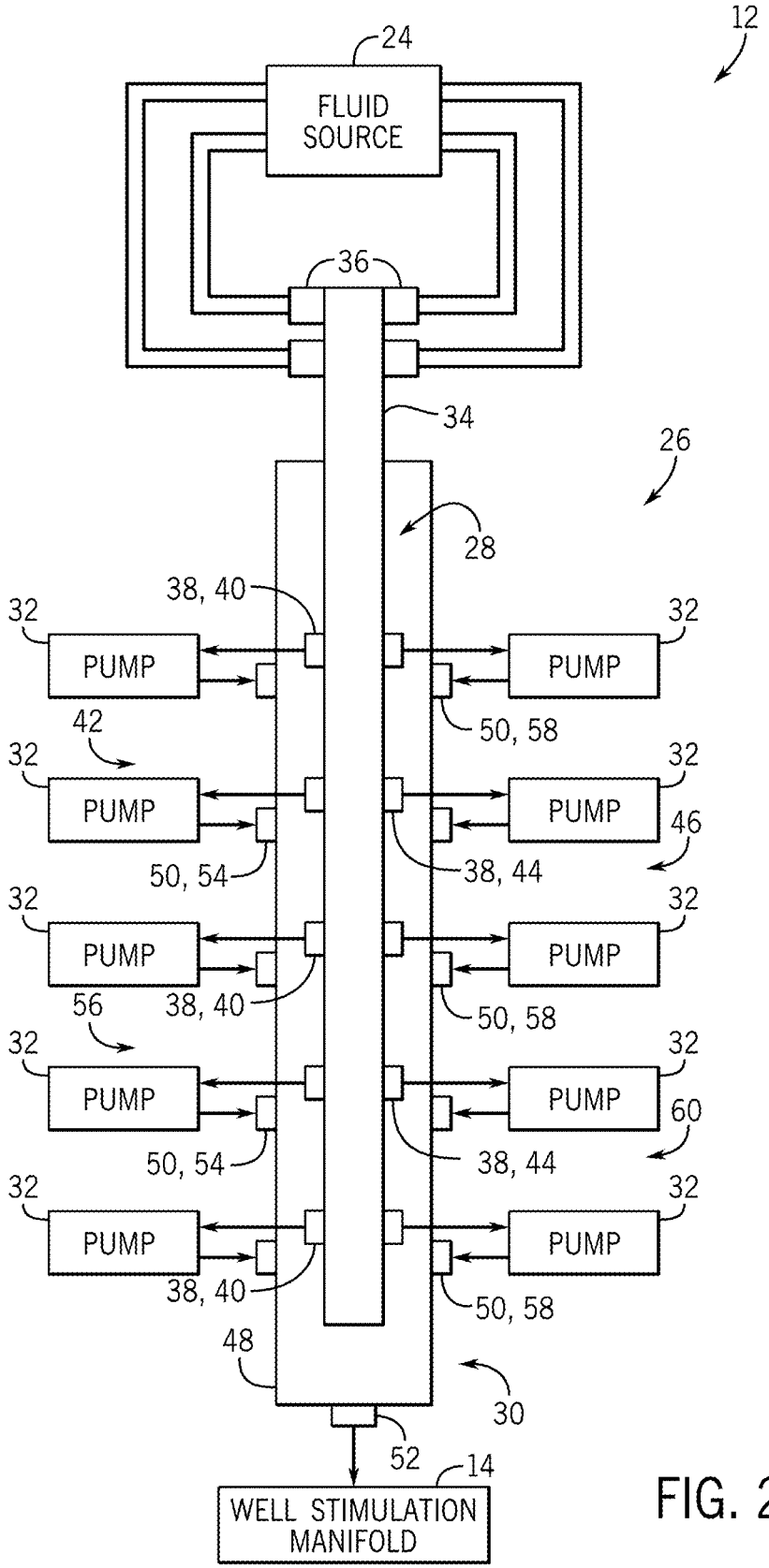
FIG. 2 is a block diagram of an embodiment of a well stimulation fluid supply system that may be employed within the well stimulation system of FIG. 1.

FIG. 2 is a block diagram of an embodiment of a well stimulation fluid supply system 12 that may be employed within the well stimulation system of FIG. 1. In the illustrated embodiment, the well stimulation fluid supply system 12 includes a fluid source 24. The fluid source 24 is configured to output low-pressure fluid (e.g., low-pressure fracturing fluid). The fracturing fluid may include water and proppant (e.g., sand, ceramic particles, etc.). The fracturing fluid may also include one or more chemical additives (e.g., acid, etc.). In certain embodiments, the fluid source 24 includes a water source that may include one or more water tanks, one or more ponds, one or more pumps, other suitable component(s), or a combination thereof. In addition, in certain embodiments, the fluid source 24 includes a blending unit configured to blend the water with the proppant and/or the chemical additives to form the low-pressure fracturing fluid. The blending unit may also include one or more pumps configured to pump the fracturing fluid to the fluid conduit assembly.

In addition, the well stimulation fluid supply system 12 includes a fluid conduit assembly 26 having a low-pressure monobore conduit assembly 28 and a high-pressure monobore conduit assembly 30. The well stimulation fluid supply system 12 also includes multiple fluid pumps 32. As discussed in detail below, the low-pressure monobore conduit assembly 28 is configured to receive the low-pressure fluid from the fluid source 24 and to output the low-pressure fluid to the fluid pumps 32, and the high-pressure monobore conduit assembly 30 is configured to receive the high-pressure fluid (e.g., high-pressure fracturing fluid) from the fluid pumps 32. As previously discussed, each fluid pump 32 is configured to receive the low-pressure fluid, substantially increase the pressure of the fluid, and output the high-pressure fluid. In certain embodiments, one or more fluid pumps may be mounted on a respective truck, and each truck may position the respective fluid pump(s) at a location suitable for interfacing with the fluid conduit assembly 26.

In the illustrated embodiment, the low-pressure monobore conduit assembly 28 includes a low-pressure monobore conduit 34, low-pressure inlets 36, and low-pressure outlets 38. The low-pressure inlets 36 are configured to direct the low-pressure fluid (e.g., low-pressure fracturing fluid) from the fluid source 24 to the low-pressure monobore conduit 34. For example, the low-pressure inlets 36 may receive the low-pressure fluid from the fluid source 24 via respective hoses and/or pipes (e.g., steel pipes, etc.). In addition, the low-pressure outlets 38 are configured to direct the low-pressure fluid from the monobore conduit 34 to the fluid pumps 32. For example, the low-pressure outlets 38 may output the low-pressure fluid to the fluid pumps 32 via respective hoses. In the illustrated embodiment, first low-pressure outlets 40 are positioned on a first lateral side 42 of the low-pressure monobore conduit 34, and second low-pressure outlets 44 are positioned on a second lateral side 46 of the low-pressure monobore conduit 34, opposite the first lateral side 42.

Furthermore, in the illustrated embodiment, the high-pressure monobore conduit assembly 30 includes a high-pressure monobore conduit 48, high-pressure inlets 50, and a high-pressure outlet 52. The high-pressure inlets 50 are configured to direct the high-pressure fluid (e.g., high-pressure fracturing fluid) from the fluid pumps 32 to the high-pressure monobore conduit 48. In addition, the high-pressure outlet 52 is configured to direct the high-pressure fluid toward the well(s) via the well stimulation manifold 14. As previously discussed, the well stimulation system may include any suitable number of well stimulation manifolds (e.g., one well stimulation manifold, as illustrated, or more well stimulation manifolds). In the illustrated embodiment, first high-pressure inlets 54 are positioned on a first lateral side 56 of the high-pressure monobore conduit 48, and second high-pressure inlets 58 are positioned on a second lateral side 60 of the high-pressure monobore conduit 48, opposite the first lateral side 56. As used herein, "monobore conduit" refers to a single respective longitudinal conduit within the fluid conduit assembly, as compared to a multi-bore conduit assembly having two or more longitudinal conduits (e.g., fluidly coupled to one another, such as via u-shaped tube(s), etc.). Accordingly, in the illustrated embodiment, the fluid conduit assembly includes a single low-pressure conduit and a single high-pressure conduit.

Because the low-pressure outlets are disposed on both lateral sides of the low-pressure monobore conduit and the high-pressure inlets are disposed on both lateral sides of the high-pressure monobore conduit, the fluid pumps may be disposed on both lateral sides of the fluid conduit assembly, thereby reducing the length and width of the well stimulation fluid supply system (e.g., as compared to a fluid conduit assembly having low-pressure outlets on one side of a low-pressure conduit and/or high-pressure inlets on one side of a high-pressure conduit). In addition, because the fluid conduit assembly has a single low-pressure conduit and a single high-pressure conduit, the cost of fabrication, installation, operation, and product lifecycle management of the fluid conduit assembly may be significantly reduced (e.g., as compared to a fluid conduit assembly having one or more low-pressure conduits on each lateral side of a high-pressure conduit). Furthermore, utilizing a single low-pressure conduit may increase the fluid velocity of the low-pressure fluid within the low-pressure monobore conduit (e.g., as compared to a fluid conduit assembly having multiple low-pressure conduits), thereby substantially reducing settling of the proppant within the low-pressure fluid. As a result, the possibility of forming flow restriction(s) within the low-pressure monobore conduit, within flow passages extending from the low-pressure monobore conduit to the fluid pumps (e.g., including hose(s), metal pipe(s), etc.), within the fluid pumps, within flow passages extending from the fluid pumps to the high-pressure monobore conduit (e.g., including hose(s), metal pipe(s), etc.), and within the high-pressure monobore conduit may be substantially reduced. Accordingly, the possibility of pump starvation may be substantially reduced or eliminated. In addition, utilizing a single low-pressure conduit may reduce the number of connections within the well stimulation fluid supply system (e.g., as compared to a fluid conduit assembly having multiple low-pressure conduits), thereby reducing setup costs, reducing operational costs, and reducing the number of possible leak paths. In addition, because the fluid conduit assembly has a single low-pressure conduit, the length of the low-pressure conduit may be adjusted without reworking any other portion of the fluid conduit assembly (e.g., as compared to a multi-bore low-pressure conduit assembly in which changing the length of one conduit includes changing the length of at least one other conduit). As a result, the maintenance and product lifecycle costs may be reduced.

While the well stimulation fluid supply system includes ten pumps in the illustrated embodiment, in other embodiments, the well stimulation fluid supply system may include more or fewer pumps. For example, as discussed in detail below, the fluid conduit assembly may be modular, and a number of pumps, a number of corresponding low-pressure outlets, and a number of corresponding high-pressure inlets may be selected for a particular application. The fluid conduit assembly may then be formed from modules to establish the selected number of low-pressure outlets and the selected number of high-pressure inlets. Furthermore, while the low-pressure outlets are positioned on both lateral sides of the low-pressure monobore conduit and the high-pressure inlets are positioned on both lateral sides of the high-pressure monobore conduit in the illustrated embodiment, in other embodiments, the low-pressure outlets may be positioned on a single lateral side of the low-pressure monobore conduit and/or the high-pressure inlets may be positioned on a single lateral side of the high-pressure monobore conduit.

Figure 3:
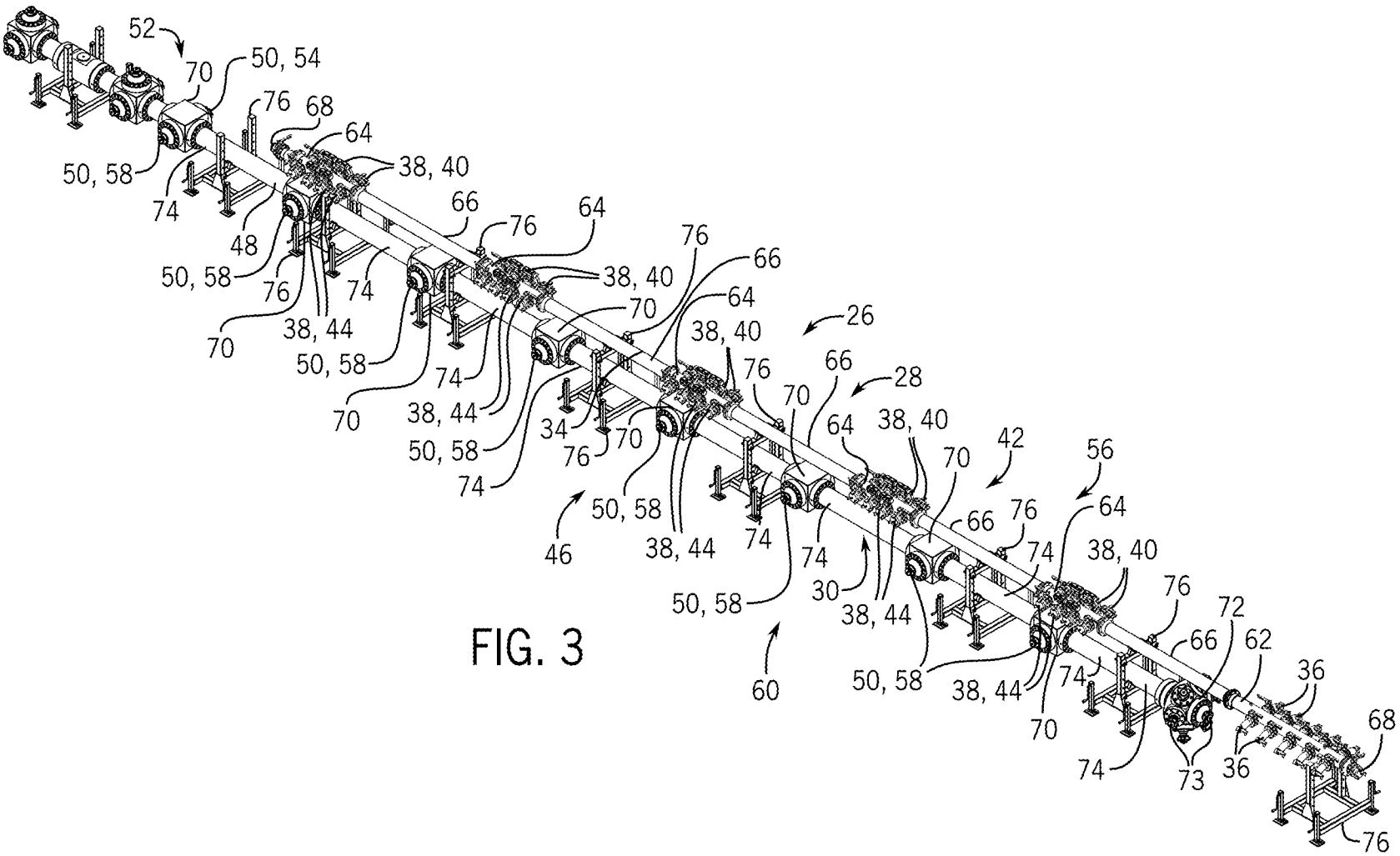
FIG. 3 is a perspective view of an embodiment of a fluid conduit assembly that may be employed within the well stimulation fluid supply system of FIG. 2.

FIG. 3 is a perspective view of an embodiment of a fluid conduit assembly 26 that may be employed within the well stimulation fluid supply system of FIG. 2. As previously discussed, the low-pressure monobore conduit assembly 28 includes a low-pressure monobore conduit 34, low-pressure inlets 36, and low-pressure outlets 38. The low-pressure inlets 36 are configured to direct the low-pressure fluid (e.g., low-pressure fracturing fluid) from the fluid source to the low-pressure monobore conduit 34. In addition, the low-pressure outlets 38 are configured to direct the low-pressure fluid from the monobore conduit 34 to the fluid pumps. In the illustrated embodiment, the first low-pressure outlets 40 are positioned on the first lateral side 42 of the low-pressure monobore conduit 34, and the second low-pressure outlets 44 are positioned on the second lateral side 46 of the low-pressure monobore conduit 34, opposite the first lateral side 42.

Furthermore, as previously discussed, the high-pressure monobore conduit assembly 30 includes a high-pressure monobore conduit 48, high-pressure inlets 50, and a high-pressure outlet 52. The high-pressure inlets 50 are configured to direct the high-pressure fluid (e.g., high-pressure fracturing fluid) from the fluid pumps to the high-pressure monobore conduit 48. In addition, the high-pressure outlet 52 is configured to direct the high-pressure fluid toward the well. In the illustrated embodiment, the first high-pressure inlets 54 are positioned on the first lateral side 56 of the high-pressure monobore conduit 48, and the second high-pressure inlets 58 are positioned on the second lateral side 60 of the high-pressure monobore conduit 48, opposite the first lateral side 56. In the illustrated embodiment, each first high-pressure inlet 54 is aligned with a respective opposing second high-pressure inlet 58 along a longitudinal axis of the high-pressure monobore conduit. However, in other embodiments, at least one first high-pressure inlet may be offset from a respective opposing second high-pressure inlet along the longitudinal axis.

In the illustrated embodiment, the low-pressure monobore conduit assembly 28 includes ten low-pressure inlets 36. However, in other embodiments, the low-pressure monobore conduit assembly may include more or fewer low-pressure inlets (e.g., 1, 2, 3, 4, 5, 6, 7, 8, 9, 11, 12, or more). Furthermore, in the illustrated embodiment, the low-pressure inlets 36 are positioned on both lateral sides of the low-pressure monobore conduit 34. However, in other embodiments, the low-pressure inlets may be positioned on a single lateral side of the low-pressure monobore conduit. In addition, in the illustrated embodiment, the low-pressure monobore conduit assembly 28 includes ten sets of low-pressure outlets 38 (e.g., in which each set of low-pressure outlets includes four low-pressure outlets). However, in other embodiments, the low-pressure monobore conduit assembly may include more or fewer sets of low-pressure outlets (e.g., one set of low-pressure outlets for each pump). Furthermore, while each set of low-pressure outlets includes four low-pressure outlets in the illustrated embodiment, in other embodiments, at least one set of low-pressure outlets may include more or fewer low-pressure outlets (e.g., 1, 2, 3, 5, 6, or more). In addition, while the low-pressure outlets are positioned on both lateral sides of the low-pressure monobore conduit in the illustrated embodiment, in other embodiments, the low-pressure outlets may be positioned on a single lateral side of the low-pressure monobore conduit.

In the illustrated embodiment, the high-pressure monobore conduit assembly 30 includes sixteen high-pressure inlets 50. However, in other embodiments, the high-pressure monobore conduit assembly may include more or fewer high-pressure inlets (e.g., 2, 4, 6, 8, 10, 12, 14, 18, 20, or more). Furthermore, while the high-pressure inlets are positioned on both lateral sides of the high-pressure monobore conduit in the illustrated embodiment, in other embodiments, the high-pressure inlets may be positioned on a single lateral side of the high-pressure monobore conduit. In addition, in the illustrated embodiment, the high-pressure monobore conduit assembly 30 includes one high-pressure outlet 52. However, in other embodiments, the high-pressure monobore conduit assembly may include more high-pressure outlets (e.g., 2, 3, 4, 5, 7, 8, or more). For example, the high-pressure monobore conduit assembly may include one or more high-pressure outlets for each well stimulation manifold.

The low-pressure monobore conduit 34 may have any suitable inner diameter. In certain embodiments, the low-pressure monobore conduit 34 has a substantially constant inner diameter. Accordingly, the cost of the low-pressure monobore conduit may be substantially reduced (e.g., as compared to a low-pressure conduit having a diameter that increases or decreases along the length of the conduit from the low-pressure inlet(s) toward the low-pressure outlets). However, in other embodiments, the inner diameter of the low-pressure monobore conduit may vary along the length of the low-pressure monobore conduit (e.g., one section of the low-pressure monobore conduit may have a larger inner diameter than another section of the low-pressure monobore conduit). Furthermore, the low-pressure inlets 36 may have any suitable inner diameter, and the low-pressure outlets 38 may have any suitable inner diameter. The low-pressure monobore conduit 34 may be configured to accommodate a variety of flow rates (e.g., about 60 to about 120 barrels/minute) and/or a variety of pressures (e.g., about 80 psi to about 120 psi).

In certain embodiments, the fluid conduit assembly may be formed from modules. In the illustrated embodiment, the low-pressure monobore conduit assembly 28 includes an inlet module 62, outlet modules 64, and spacer modules 66. The modules may be coupled to one another by any suitable type(s) of separable connection(s) (e.g., flanged connection(s), connection(s) established by coupler(s), threaded connection(s), a GRAYLOC® coupling, a VICTAULIC® coupling, a WECO® coupling, etc.). The inlet module 62 includes the low-pressure inlet(s) 36, each outlet module 64 includes one or more respective low-pressure outlets 38, and the spacer modules 66 are configured to establish a desired spacing between the outlet modules and between the inlet module and the outlet modules. Each spacer module 66 may have any suitable length, such as 5 feet (1.524 m), 10 feet (3.048 m), or 20 feet (6.096 m). The length of the spacer modules may be selected (e.g., from a set of spacer modules having different lengths) to substantially align each outlet module with respective fluid pump(s), thereby reducing the length of the conduit(s) (e.g., hose(s), etc.) that fluidly couple the respective low-pressure outlet(s) to the fluid pump(s). In addition, the number of outlet modules 64 within the low-pressure monobore conduit assembly 28 and the number of fluid pumps may be particularly selected for a particular application (e.g., target flow rate of the high-pressure fluid).

In the illustrated embodiment, the low-pressure monobore conduit assembly 28 includes end caps 68 coupled to the low-pressure monobore conduit 34 and configured to block flow of the low-pressure fluid from the longitudinal ends of the low-pressure monobore conduit 34. Furthermore, in the illustrated embodiment, each outlet module 64 has a short length (e.g., longitudinal extent), such as 3 feet (0.9144 m), 4 feet (1.2192 m), or 5 feet (1.524 m). The short length of the outlet modules facilitates accurate placement of the low-pressure outlets along the low-pressure monobore conduit assembly, thereby enabling the low-pressure outlets to be substantially aligned with respective fluid pumps. Furthermore, because the low-pressure outlets 38 are formed on the outlet modules 64 and the low-pressure inlets 36 are formed on the inlet module 62, the process of replacing worn inlet(s) and outlet(s) may involve replacing the respective module(s), thereby substantially reducing the duration and costs associated with maintenance operations. In addition, in certain embodiments, a worn section of a spacer module may be removed (e.g., by cutting out the worn section and welding the remaining sections to one another). As a result, the length of the low-pressure monobore conduit may be reduced without reworking any other portion of the fluid conduit assembly (e.g., as compared to a multi-bore low-pressure conduit assembly in which changing the length of one conduit includes changing the length of at least one other conduit).

While the inlet/outlet modules and the spacer modules are separate components in the illustrated embodiment, in other embodiments, at least one inlet module and/or at least one outlet module may include an integrated spacer. In such embodiments, the respective spacer module(s) may be omitted and the longitudinal separation distance between respective inlets/outlets may be established by the integrated spacer(s). The integrated spacers may be available in multiple lengths to establish the desired longitudinal spacing between the respective inlets/outlets. Furthermore, in certain embodiments, at least one module may include multiple sets of low-pressure outlets separated from one another by an integral spacer. In addition, while the low-pressure monobore conduit assembly 28 includes the inlet module 62 and the outlet modules 64 in the illustrated embodiment, in other embodiments, the inlet module may be omitted, and an outlet module (e.g., positioned at a longitudinal end of the low-pressure monobore conduit assembly) may be used to receive the low-pressure fluid from the fluid source. In such embodiments, the low-pressure inlet(s) may be formed by the low-pressure outlet(s) of the outlet module. While the low-pressure monobore conduit assembly is formed by modules in the illustrated embodiment, in other embodiments, the low-pressure monobore conduit assembly may be formed by any other suitable structural configuration, such as a structural configuration having a continuous low-pressure monobore conduit (e.g., with no connection joints along the low-pressure monobore conduit). Furthermore, in certain embodiments, a port may be placed on a module of the low-pressure monobore conduit, and the port may be in fluid communication with a pressure monitoring device (e.g., gauge, pressure transducer, etc.), thereby facilitating pressure monitoring within the low-pressure monobore conduit.

In the illustrated embodiment, the high-pressure monobore conduit assembly 30 includes inlet modules 70, a secondary multi-inlet module 72, and spacer modules 74. The modules may be coupled to one another by any suitable type(s) of separable connection(s) (e.g., flanged connection(s), connection(s) established by coupler(s), threaded connection(s), a GRAYLOC® coupling, a VICTAULIC® coupling, a WECO® coupling, etc.). The secondary multi-inlet module 72 includes multiple secondary high-pressure inlets 73, each inlet module 70 includes one or more respective high-pressure inlets 50, and the spacer modules 74 are configured to establish a desired spacing between the inlet modules and between the inlet modules and the multi-inlet module. The secondary high-pressure inlets 73 are configured to receive the high-pressure fluid from one or more fluid pumps. In the illustrated embodiment, the secondary multi-inlet module 72 includes seven secondary high-pressure inlets 73. However, in other embodiments, the secondary multi-inlet module may include more or fewer secondary high-pressure inlets (e.g., 1, 2, 3, 4, 5, 6, 8, or more). Furthermore, in certain embodiments, the secondary multi-inlet module may be omitted (e.g., a blind flange may be coupled to a longitudinal end of an inlet module or a spacer module). In the illustrated embodiment, the high-pressure outlet 52 is positioned at a longitudinal end of an inlet module 70. However, in other embodiments, the high-pressure outlet may be positioned at any other suitable location within the high-pressure monobore conduit assembly. The length of the spacer modules may be selected (e.g., from a set of spacer modules having different lengths) to substantially align each inlet module with respective fluid pump(s), thereby reducing the length of the conduit(s) (e.g., hose(s), etc.) that fluidly couple the respective high-pressure inlet(s) to the fluid pump(s). In addition, the number of inlet modules 70 within the high-pressure monobore conduit assembly 30 and the number of fluid pumps may be particularly selected for a particular application (e.g., target flow rate of the high-pressure fluid).

Because the high-pressure inlets 50 are formed on the inlet modules 70, the process of replacing worn inlet(s) and outlet(s) may involve replacing the respective module(s), thereby substantially reducing the duration and costs associated with maintenance operations. While the inlet/outlet modules and the spacer modules are separate components in the illustrated embodiment, in other embodiments, at least one inlet module and/or at least one outlet module may include an integrated spacer. In such embodiments, the respective spacer module(s) may be omitted and the longitudinal separation distance between respective inlets/outlets may be established by the integrated spacer(s). The integrated spacers may be available in multiple lengths to establish the desired longitudinal spacing between the respective inlets/outlets. Furthermore, in certain embodiments, at least one module may include multiple high-pressure inlets separated from one another by an integral spacer. In addition, while the high-pressure monobore conduit assembly is formed by modules in the illustrated embodiment, in other embodiments, the high-pressure monobore conduit assembly may be formed by any other suitable structural configuration, such as a structural configuration having a continuous high-pressure monobore conduit (e.g., with no connection joints along the high-pressure monobore conduit).

In the illustrated embodiment, the low-pressure monobore conduit assembly 28 and the high-pressure monobore conduit assembly 30 are supported on the ground by multiple stands 76 (e.g., which may be directly engaged with the ground). The stands 76 may be formed from any suitable material (e.g., metal, such as steel, wood, polymeric material, composite material, etc.), and the stands 76 may be positioned at any suitable locations along the longitudinal extent of the fluid conduit assembly 26. While the fluid conduit assembly 26 includes nine stands 76 in the illustrated embodiment, in other embodiments, the fluid conduit assembly may include more or fewer stands (e.g., 1, 2, 3, 4, 5, 6, 7, 8, 10, 11, 12, or more). Because the low-pressure monobore conduit assembly 28 and the high-pressure monobore conduit assembly 30 are supported by stands 76 (e.g., which directly engage the ground, which engage a plate/board positioned on the ground, etc.), the manufacturing cost and setup cost of the fluid conduit assembly may be substantially reduced (e.g., as compared to a fluid conduit assembly formed on skids). For example, due to the small size of each stand and each module, lighter equipment having a lower acquisition/rental cost may be used to lift and position each component (e.g., as compared to heavier equipment having a higher acquisition/rental cost used to lift and position each skid). In addition, the stands and the modular construction of the fluid conduit assembly enable the fluid conduit assembly to be configured in the field (e.g., as compared to a fluid conduit assembly mounted on a truck, trailer, skid, platform, etc.). Furthermore, because certain stands support the low-pressure monobore conduit assembly and the high-pressure monobore conduit assembly (e.g., the stands positioned within the overlapping portion of the monobore conduit assemblies) and because the fluid conduit assembly includes a single low-pressure conduit, the number of components within the fluid conduit assembly may be reduced (e.g., as compared to a fluid conduit assembly having multiple low-pressure conduits, and/or a fluid conduit assembly having a low-pressure conduit assembly and a high-pressure conduit assembly supported by separate supports). In certain embodiments, at least one stand may include a height adjustment system configured to control a height of the high-pressure monobore conduit and/or the low-pressure monobore conduit above the ground, and/or a leveling system configured to enable the stand to accommodate an uneven/sloped ground surface.

Figure 4:
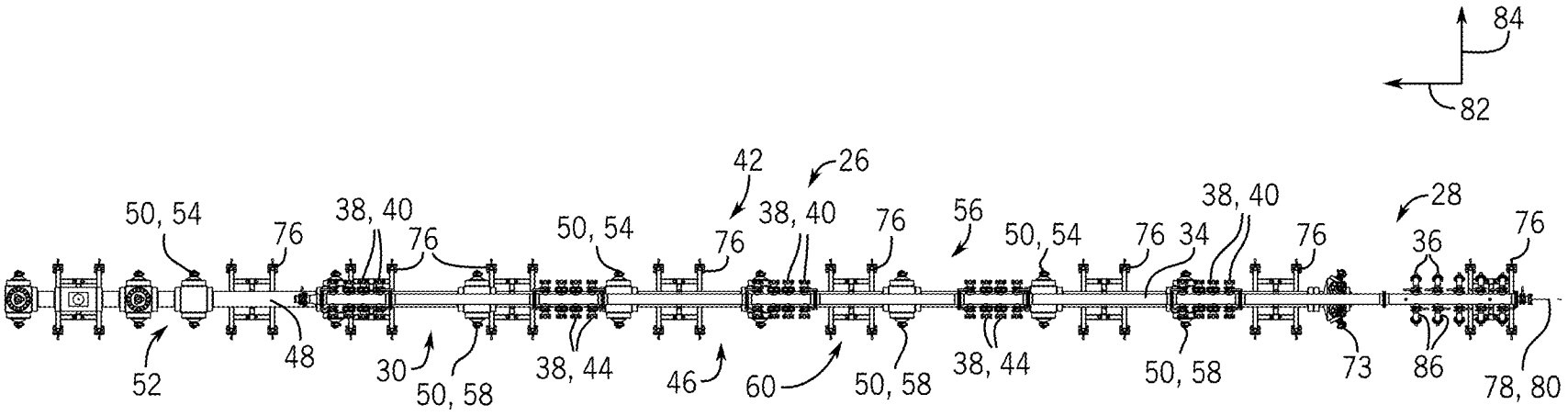
FIG. 4 is a top view of the fluid conduit assembly of FIG. 3.

FIG. 4 is a top view of the fluid conduit assembly 26 of FIG. 3. In the illustrated embodiment, a longitudinal axis 78 of the low-pressure monobore conduit 34 is substantially parallel to a longitudinal axis 80 of the high-pressure monobore conduit 48. Accordingly, the longitudinal axes of the monobore conduits extend substantially along a longitudinal axis 82 of the fluid conduit assembly 26. As used herein, "substantially parallel" refers to an angle between the longitudinal axis 78 of the low-pressure monobore conduit 34 and the longitudinal axis 80 of the high-pressure monobore conduit 48 of less than a threshold angle. The threshold angle may be about 5 degrees, about 4 degrees, about 3 degrees, about 2 degrees, about 1 degree, about 0.5 degrees, or about 0.25 degrees. In addition, in the illustrated embodiment, the longitudinal axis 78 of the low-pressure monobore conduit 34 is substantially aligned with the longitudinal axis 80 of the high-pressure monobore conduit 48 along a lateral axis 84 of the fluid conduit assembly 26. As used herein with regard to longitudinal axes, "substantially aligned" refers to a lateral offset (e.g., offset along the lateral axis 84) of less than a threshold offset. The threshold offset may be about 25 cm, about 20 cm, about 15 cm, about 10 cm, about 5 cm, about 1 cm, or about 0.5 cm. The alignment of the longitudinal axes of the monobore conduits may facilitate access to both lateral sides of the low-pressure monobore conduit assembly and the high-pressure monobore conduit assembly and/or may reduce a width (e.g., extent along the lateral axis) of the fluid conduit assembly (e.g., as compared to a fluid conduit assembly having at least one low-pressure conduit positioned on each lateral side of the high-pressure conduit). While the longitudinal axes of the monobore conduits are substantially parallel to one another and substantially laterally aligned with one another in the illustrated embodiment, in other embodiments, the longitudinal axes of the monobore conduits may be laterally offset from one another and/or oriented at an angle relative to one another.

In the illustrated embodiment, each low-pressure inlet 36 includes a fluid passage 86 configured to independently direct the low-pressure fluid from the fluid source to the low-pressure monobore conduit 34. Accordingly, the low-pressure monobore conduit assembly does not include an additional manifold (e.g., in addition to the low-pressure monobore conduit) configured to collect the low-pressure fluid from multiple conduits and to direct the collected low-pressure fluid to the low-pressure monobore conduit. As a result, the cost of the fluid conduit assembly may be substantially reduced, as compared to a low-pressure conduit assembly having an additional manifold.

In the illustrated embodiment, the low-pressure monobore conduit and the high-pressure monobore conduit are substantially linear. Accordingly, the modules of the fluid conduit assembly may be relatively narrow, thereby facilitating transport of the modules via a truck/trailer (e.g., as compared to components with more complex shapes). However, in other embodiments, the low-pressure monobore conduit and/or the high-pressure monobore conduit may have another suitable shape (e.g., curved, bent, wavy, etc.). For example, in certain embodiments, the portion of the low-pressure monobore conduit to which the fluid passages of the low-pressure inlets are coupled may be angled (e.g., at a 90 degree angle) relative to the remainder of the low-pressure monobore conduit.

Figure 5:
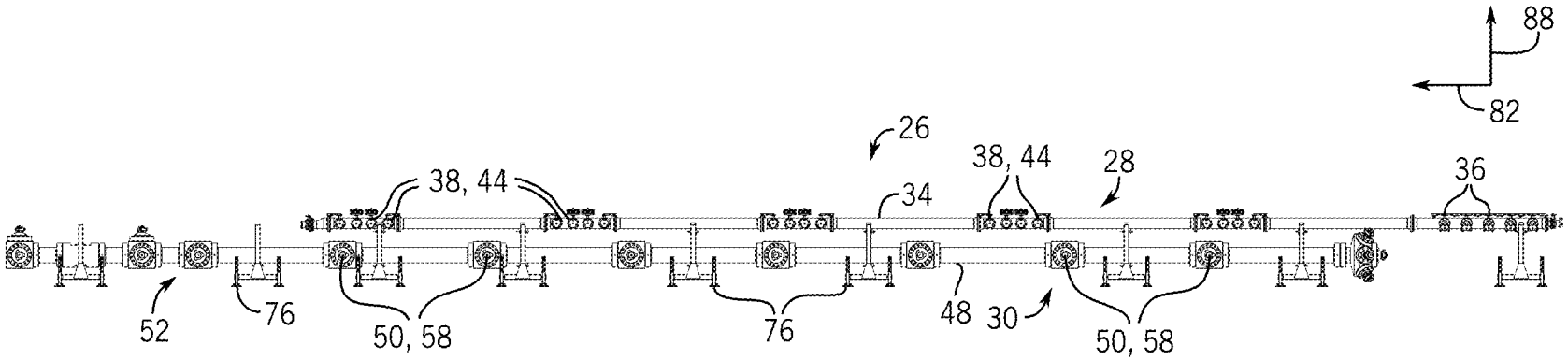
FIG. 5 is a side view of the fluid conduit assembly of FIG. 3.

FIG. 5 is a side view of the fluid conduit assembly 26 of FIG. 3. In the illustrated embodiment, the low-pressure monobore conduit 34 is positioned above the high-pressure monobore conduit 48 along a vertical axis 88 of the fluid conduit assembly. However, in other embodiments, the low-pressure monobore conduit may be positioned below the high-pressure monobore conduit. In such embodiments, the longitudinal axis of the low-pressure monobore conduit may be substantially parallel to the longitudinal axis of the high-pressure monobore conduit, and/or the longitudinal axis of the low-pressure monobore conduit may be substantially aligned with the longitudinal axis of the high-pressure monobore conduit along the lateral axis of the fluid conduit assembly. Furthermore, in certain embodiments, the low-pressure monobore conduit and the high-pressure monobore conduit may be positioned at the same height along the vertical axis. In such embodiments, the longitudinal axis of the low-pressure monobore conduit may be substantially parallel to the longitudinal axis of the high-pressure monobore conduit.

Figure 6:
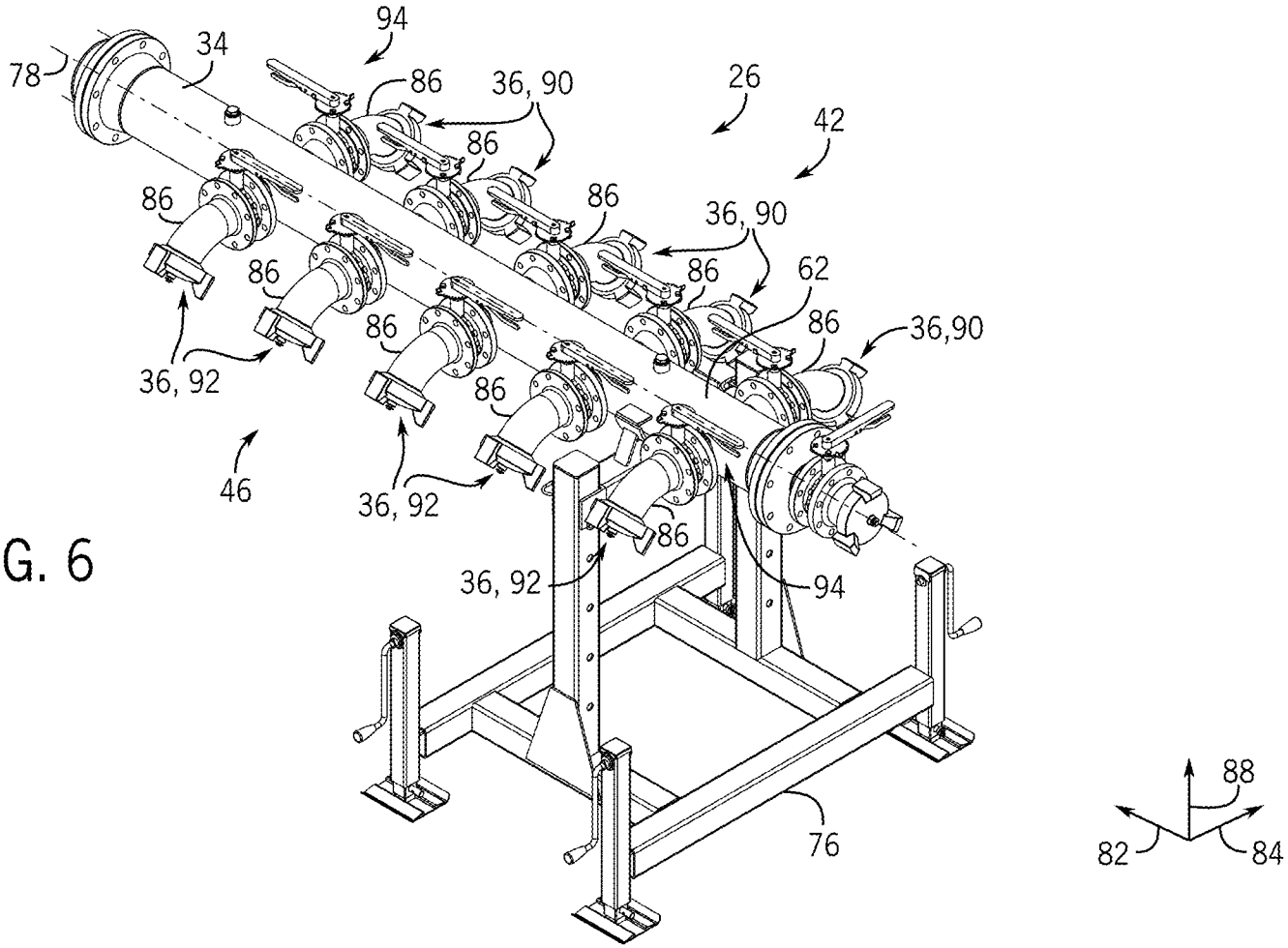
FIG. 6 is a perspective view of a portion of the fluid conduit assembly of FIG. 3.

FIG. 6 is a perspective view of a portion of the fluid conduit assembly 26 of FIG. 3. As previously discussed, each low-pressure inlet 36 includes a fluid passage 86 configured to independently direct the low-pressure fluid from the fluid source to the low-pressure monobore conduit 34. In the illustrated embodiment, first low-pressure inlets 90 are positioned on the first lateral side 42 of the low-pressure monobore conduit 34, and second low-pressure inlets 92 are positioned on the second lateral side 46 of the low-pressure monobore conduit 34. Because the low-pressure inlets 36 are positioned on opposite sides of the low-pressure monobore conduit 34, opposing flows of low-pressure fluid (e.g., low-pressure fracturing fluid) are established within the low-pressure monobore conduit 34, thereby mixing the water and the proppant within the low-pressure fluid. As a result, proppant settling within the low-pressure monobore conduit may be substantially reduced. In addition, because the low-pressure inlets are positioned on opposite sides of the low-pressure monobore conduit 34, the diameter of the low-pressure monobore conduit may be reduced (e.g., as compared to a conduit in which multiple low-pressure inlets are arranged along the vertical axis).

In the illustrated embodiment, each first low-pressure inlet 90 is substantially aligned with a respective opposing second low-pressure inlet 92 along the longitudinal axis 78 of the low-pressure monobore conduit (e.g., the longitudinal axis 82 of the fluid conduit assembly). In addition, each fluid passage 86 extends substantially perpendicularly to the low-pressure monobore conduit 34. Accordingly, the flow of low-pressure fluid from each first low-pressure inlet 90 directly impacts the flow of low-pressure fluid from the respective opposing second low-pressure inlet 92. As a result, the energy of the flows may be effectively dissipated, thereby efficiently establishing a well-mixed downstream flow of water and proppant through the low-pressure monobore conduit (e.g., as compared to flow passages that are aligned with structural component(s), and the flow of fluid from each flow passage impacts the respective structural component). While each first low-pressure inlet is substantially aligned with a respective opposing second low-pressure inlet along the longitudinal axis 78 in the illustrated embodiment, in other embodiments, at least one first low-pressure inlet may be offset from a respective second low-pressure inlet along the longitudinal axis. Furthermore, in the illustrated embodiment, each fluid passage 86 is curved and angled toward the ground. However, in other embodiments, at least one fluid passage may have any other suitable shape/configuration and/or orientation. For example, at least one fluid passage may extend laterally outward from the low-pressure monobore conduit along a path substantially parallel to the ground. Furthermore, in certain embodiments, at least one fluid passage may be oriented at any suitable angle about the vertical axis and/or the longitudinal axis. For example, the low-pressure inlets of at least one pair of opposing low-pressure inlets may be oriented at substantially the same angle about the vertical axis and/or the longitudinal axis. While the low-pressure monobore conduit assembly includes low-pressure inlets on both lateral sides of the low-pressure monobore conduit in the illustrated embodiment, in other embodiments, the low-pressure inlets may be positioned on a single side of the low-pressure monobore conduit. In addition, in the illustrated embodiment, each low-pressure inlet 36 includes a respective valve 94 (e.g., manually actuated valve, electrically actuated valve, etc.) configured to control flow of the low-pressure fluid into the low-pressure monobore conduit. However, in other embodiments, the valve may be omitted from at least one low-pressure inlet.

In certain embodiments, the fluid source may provide the same low-pressure fluid to each low-pressure inlet of the low-pressure monobore conduit assembly. However, in other embodiments, the fluid source may provide multiple low-pressure fluids to the low-pressure inlets. For example, in certain embodiments, the fluid source may provide a mixture of water and proppant to certain low-pressure inlet(s), the fluid source may provide water alone to certain low-pressure inlet(s), the fluid source may provide one or more chemicals (e.g., acid, etc.) to certain low-pressure inlet(s), the fluid source may provide other suitable fluid(s) to certain low-pressure inlet(s), or a combination thereof. In certain embodiments, the fluid source may provide the same fluid to one or more opposing pairs of low-pressure inlets. For example, the fluid source may provide the mixture of water and proppant to one or more first low-pressure inlets and one or more respective opposing second low-pressure inlets, such that the flow of the water/proppant mixture from each first low-pressure inlet directly impacts the flow of the water/proppant mixture from the respective opposing second low-pressure inlet. As a result, the energy of the flows may be effectively dissipated, thereby efficiently establishing a well-mixed downstream flow of water and proppant through the low-pressure monobore conduit. By way of example, the fluid source may provide the mixture of water and proppant to three first low-pressure inlets and three respective opposing second low-pressure inlets, the fluid source may provide water alone to one first low-pressure inlet and a respective opposing second low-pressure inlet, and the fluid source may provide one or more chemicals to one first low-pressure inlet and a respective opposing second low-pressure inlet.

Figure 7:
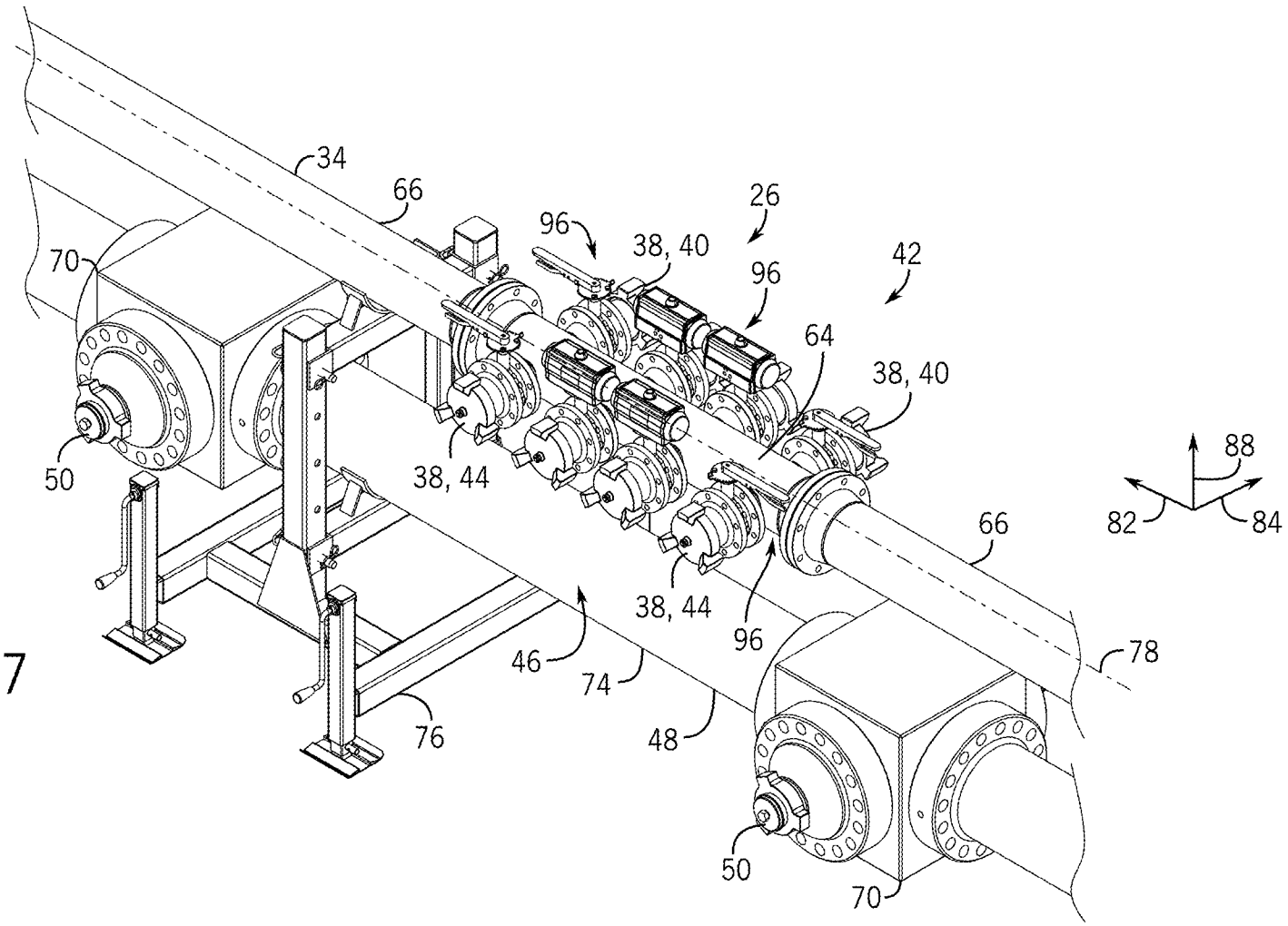
FIG. 7 is a perspective view of another portion of the fluid conduit assembly of FIG. 3.

FIG. 7 is a perspective view of another portion of the fluid conduit assembly 26 of FIG. 3. As previously discussed, each set of low-pressure outlets 38 includes four low-pressure outlets. However, in other embodiments, at least one set of low-pressure outlets may include more or fewer low-pressure outlets (e.g., 1, 2, 3, 5, 6, or more). In the illustrated embodiment, each first low-pressure outlet 40 is aligned with a respective opposing second low-pressure outlet 44 along the longitudinal axis 78 of the low-pressure monobore conduit (e.g., along the longitudinal axis 82 of the fluid conduit assembly). However, in other embodiments, at least one first low-pressure outlet may be offset from a respective opposing second low-pressure outlet along the longitudinal axis. In addition, in the illustrated embodiment, each low-pressure outlet 38 includes a respective valve 96 (e.g., manually actuated valve, electrically actuated valve, etc.) configured to control flow of the low-pressure fluid from the low-pressure monobore conduit. However, in other embodiments, the valve may be omitted from at least one low-pressure outlet.

In certain embodiments, at least one low-pressure outlet may include a respective fluid passage configured to direct the low-pressure fluid from the low-pressure monobore conduit to/toward a fluid pump. In such embodiments, each fluid passage may have any suitable shape/configuration and/or orientation. For example, at least one fluid passage may extend laterally outward from the low-pressure monobore conduit along a path substantially parallel to the ground. Furthermore, in certain embodiments, at least one fluid passage may be oriented at any suitable angle about the vertical axis and/or the longitudinal axis.

In the embodiments disclosed above, each low-pressure inlet is disposed on a lateral side (e.g., first lateral side or second lateral side) of the low-pressure monobore conduit, each low- pressure outlet is disposed on a lateral side (e.g., first lateral side or second lateral side) of the low-pressure monobore conduit, and each high-pressure inlet is disposed on a lateral side (e.g., first lateral side or second lateral side) of the high-pressure monobore conduit. However, in certain embodiments, at least one low-pressure inlet, at least one low-pressure outlet, at least one high-pressure inlet, or a combination thereof, may be positioned on another suitable side of the respective monobore conduit (e.g., a vertical side, etc.). For example, in certain embodiments, certain low-pressure outlets (e.g., all of the low-pressure outlets, etc.) may be positioned on opposite vertical sides of the low-pressure monobore conduit, and/or certain low-pressure inlets (e.g., all of the low-pressure inlets, etc.) may be positioned on opposite vertical sides of the low-pressure monobore conduit. In such embodiments, at least one of the inlets/outlets may include a fluid passage that extends toward a lateral side of the fluid conduit assembly. Additionally or alternatively, at least one of the inlets/outlets may include a fluid passage that extends toward a longitudinal end of the respective monobore conduit. For example, in certain embodiments, at least one low-pressure inlet may include a curved/bent fluid passage having an inlet opening oriented substantially perpendicularly to the longitudinal axis of the low-pressure monobore conduit. As used herein, "side of the [low-pressure/high-pressure] monobore conduit" refers to a side of a plane extending through the longitudinal axis of the respective monobore conduit.

Furthermore, in the embodiments disclosed above, each pair of opposing inlets/outlets are circumferentially offset from one another by about 180 degrees. However, in other embodiments, at least one pair of opposing inlets/outlets may be circumferentially offset from one another by any suitable angle (e.g., about 20 degrees, about 40 degrees, about 60 degrees, about 80 degrees, about 90 degrees, about 100 degrees, about 120 degrees, about 140 degrees, about 160 degrees, etc.). Furthermore, each inlet and each outlet of the fluid conduit assembly may be positioned at any suitable circumferential location along the respective monobore conduit, and the respective fluid passage may be oriented at any suitable angle about the vertical axis, the longitudinal axis, the lateral axis, or a combination thereof, of the respective monobore conduit. In addition, in certain embodiments, three or more inlets/outlets may be distributed about the circumferential extend of the respective monobore conduit. For example, in certain embodiments, three inlets/outlets may be substantially aligned with one another along the respective longitudinal axis and circumferentially offset from one another by about 120 degrees. Furthermore, in certain embodiments, four inlets/outlets may be substantially aligned with one another along the respective longitudinal axis and circumferentially offset from one another by about 90 degrees. In addition, at least one monobore conduit assembly may include a first group of inlets/outlets positioned at a first longitudinal location along the respective monobore conduit and a second group of inlets/outlets positioned at a second longitudinal location along the respective monobore conduit. In such embodiments, the inlets/outlets of each group may be substantially equally spaced apart from one another along the circumferential axis, and each inlet/outlet of the first group may be circumferentially offset from a respective inlet/outlet of the second group (e.g., such that the circumferential offsets between the inlets/outlets of the groups are substantially equal). Additionally or alternatively, in certain embodiments, at least one inlet/outlet may include a curved/bent fluid passage having an inlet/outlet opening oriented substantially perpendicularly to the longitudinal axis of the respective monobore conduit.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A fluid conduit assembly for a fluid supply system, comprising:

a low-pressure monobore conduit assembly comprising a low-pressure inlet module comprising at least one low-pressure inlet, a plurality of low-pressure outlet modules comprising a plurality of low-pressure outlets, and a plurality of low-pressure spacer modules configured to establish a respective first longitudinal distance between low-pressure outlet modules of each pair of adjacent low-pressure outlet modules of the plurality of low-pressure outlet modules and between the low-pressure inlet module and the plurality of low-pressure outlet modules, wherein a low-pressure monobore conduit is formed by the low-pressure inlet module, the plurality of low-pressure outlet modules, and the plurality of low-pressure spacer modules, the at least one low-pressure inlet is configured to direct low-pressure fluid from a fluid source to the low-pressure monobore conduit, and the plurality of low-pressure outlets is configured to direct the low-pressure fluid from the low-pressure monobore conduit to a plurality of fluid pumps; and a high-pressure monobore conduit assembly comprising a plurality of high-pressure inlet modules comprising a plurality of high-pressure inlets, a plurality of high-pressure spacer modules configured to establish a respective second longitudinal distance between high-pressure inlet modules of each pair of adjacent high-pressure inlet modules of the plurality of high-pressure inlet modules, and at least one high-pressure outlet, wherein a high-pressure monobore conduit is formed by the plurality of high-pressure inlet modules and the plurality of high-pressure spacer modules, the plurality of high-pressure inlets is configured to direct high-pressure fluid from the plurality of fluid pumps to the high-pressure monobore conduit, and the at least one high-pressure outlet is configured to direct the high-pressure fluid toward a well;

wherein a longitudinal axis of at least a portion of the low-pressure monobore conduit is substantially parallel to a longitudinal axis of the high-pressure monobore conduit, and the longitudinal axis of the at least the portion of the low-pressure monobore conduit is substantially aligned with the longitudinal axis of the high-pressure monobore conduit along a lateral axis of the fluid conduit assembly.

2. The fluid conduit assembly of claim 1, wherein the at least one low- pressure inlet comprises a plurality of low-pressure inlets, and each low-pressure inlet of the plurality of low-pressure inlets comprises a fluid passage configured to independently direct the low-pressure fluid from the fluid source to the low-pressure monobore conduit.

3. The fluid conduit assembly of claim 2, wherein at least one first low-pressure inlet of the plurality of low-pressure inlets is positioned on a first side of the low-pressure monobore conduit, and at least one second low-pressure inlet of the plurality of low-pressure inlets is positioned on a second side of the low-pressure monobore conduit, opposite the first side of the low-pressure monobore conduit.

4. The fluid conduit assembly of claim 3, wherein the at least one first low-pressure inlet comprises a plurality of first low-pressure inlets, the at least one second low-pressure inlet comprises a plurality of second low-pressure inlets, and each first low-pressure inlet of the plurality of first low-pressure inlets is aligned with a respective opposing second low-pressure inlet of the plurality of second low-pressure inlets along a longitudinal axis of the low-pressure inlet module.

5. The fluid conduit assembly of claim 1, comprising a plurality of stands distributed along a longitudinal axis of the fluid conduit assembly, wherein each stand of the plurality of stands is engaged with the high-pressure monobore conduit assembly, and each stand of the plurality of stands is engaged with the low-pressure monobore conduit assembly.

6. The fluid conduit assembly of claim 1, wherein each of the plurality of low-pressure spacer modules has a respective length corresponding to the respective first longitudinal distance, the respective length of each of the plurality of low-pressure spacer modules is selected to substantially align each low-pressure outlet module of the plurality of low-pressure outlet modules with a respective fluid pump of the plurality of fluid pumps, each of the plurality of high-pressure spacer modules has a respective length corresponding to the respective second longitudinal distance, and the respective length of each of the plurality of high-pressure spacer modules is selected to substantially align each high-pressure inlet module of the plurality of high-pressure inlet modules with a respective fluid pump of the plurality of fluid pumps.

7. The fluid conduit assembly of claim 1, wherein at least one first low-pressure outlet of the plurality of low-pressure outlets is positioned on a first side of the low-pressure monobore conduit, and at least one second low-pressure outlet of the plurality of low-pressure outlets is positioned on a second side of the low-pressure monobore conduit, opposite the first side of the low-pressure monobore conduit.

8. The fluid conduit assembly of claim 7, wherein the at least one first low-pressure outlet comprises a plurality of first low-pressure outlets, and the at least one second low-pressure outlet comprises a plurality of second low-pressure outlets.

9. A fluid conduit assembly for a fluid supply system, comprising:

a low-pressure monobore conduit assembly comprising a low-pressure monobore conduit, at least one low-pressure inlet, and a plurality of low-pressure outlets, wherein the at least one low-pressure inlet is configured to direct low-pressure fluid from a fluid source to the low-pressure monobore conduit, and the plurality of low-pressure outlets is configured to direct the low-pressure fluid from the low-pressure monobore conduit to a plurality of fluid pumps; and a high-pressure monobore conduit assembly comprising a high-pressure monobore conduit, a plurality of high-pressure inlets, and at least one high-pressure outlet, wherein the plurality of high-pressure inlets is configured to direct high-pressure fluid from the plurality of fluid pumps to the high-pressure monobore conduit, and the at least one high-pressure outlet is configured to direct the high-pressure fluid toward a well;

wherein a longitudinal axis of the low-pressure monobore conduit is within a threshold angle of a longitudinal axis of the high-pressure monobore conduit, the longitudinal axis of the low-pressure monobore conduit is within a threshold offset of the longitudinal axis of the high-pressure monobore conduit along a lateral axis of the fluid conduit assembly, the threshold angle is less than or equal to 5 degrees, and the threshold offset is less than or equal to 25 centimeters.

10. The fluid conduit assembly of claim 9, wherein the at least one low-pressure inlet comprises a plurality of low-pressure inlets, and each low-pressure inlet of the plurality of low-pressure inlets comprises a fluid passage configured to independently direct the low-pressure fluid from the fluid source to the low-pressure monobore conduit.

11. The fluid conduit assembly of claim 10, wherein at least one first low-pressure inlet of the plurality of low-pressure inlets is positioned on a first side of the low-pressure monobore conduit, and at least one second low-pressure inlet of the plurality of low-pressure inlets is positioned on a second side of the low-pressure monobore conduit, opposite the first side.

12. The fluid conduit assembly of claim 11, wherein the at least one first low-pressure inlet comprises a plurality of first low-pressure inlets, the at least one second low-pressure inlet comprises a plurality of second low-pressure inlets, and each first low-pressure inlet of the plurality of first low-pressure inlets is aligned with a respective opposing second low-pressure inlet of the plurality of second low-pressure inlets along a longitudinal axis of the low-pressure monobore conduit.

13. The fluid conduit assembly of claim 9, comprising a plurality of stands distributed along a longitudinal axis of the fluid conduit assembly, wherein each stand of the plurality of stands is engaged with the high-pressure monobore conduit assembly, and each stand of the plurality of stands is engaged with the low-pressure monobore conduit assembly.

14. The fluid conduit assembly of claim 9, wherein at least one first low-pressure outlet of the plurality of low-pressure outlets is positioned on a first side of the low-pressure monobore conduit, and at least one second low-pressure outlet of the plurality of low-pressure outlets is positioned on a second side of the low-pressure monobore conduit, opposite the first side of the low-pressure monobore conduit.

15. A fluid conduit assembly for a fluid supply system, comprising:

a low-pressure monobore conduit assembly comprising a low-pressure monobore conduit, at least one low-pressure inlet, and a plurality of low-pressure outlets, wherein the at least one low-pressure inlet is configured to direct low-pressure fluid from a fluid source to the low-pressure monobore conduit, and the plurality of low-pressure outlets is configured to direct the low-pressure fluid from the low-pressure monobore conduit to a plurality of fluid pumps; and a high-pressure monobore conduit assembly comprising a high-pressure monobore conduit, a plurality of high-pressure inlets, and at least one high-pressure outlet, wherein the plurality of high-pressure inlets is configured to direct high-pressure fluid from the plurality of fluid pumps to the high-pressure monobore conduit, and the at least one high-pressure outlet is configured to direct the high-pressure fluid toward a well;

wherein a longitudinal axis of at least a portion of the low-pressure monobore conduit is substantially parallel to a longitudinal axis of the high-pressure monobore conduit, and the longitudinal axis of the at least the portion of the low-pressure monobore conduit is substantially aligned with the longitudinal axis of the high-pressure monobore conduit along a lateral axis of the fluid conduit assembly.

16. The fluid conduit assembly of claim 15, comprising a plurality of stands distributed along a longitudinal axis of the fluid conduit assembly, wherein each stand of the plurality of stands is engaged with the high-pressure monobore conduit assembly, and each stand of the plurality of stands is engaged with the low-pressure monobore conduit assembly.

17. The fluid conduit assembly of claim 15, wherein at least one first low-pressure outlet of the plurality of low-pressure outlets is positioned on a first side of the low-pressure monobore conduit, and at least one second low-pressure outlet of the plurality of low-pressure outlets is positioned on a second side of the low-pressure monobore conduit, opposite the first side of the low-pressure monobore conduit.

18. The fluid conduit assembly of claim 15, wherein the at least one low-pressure inlet comprises a plurality of low-pressure inlets, and each low-pressure inlet of the plurality of low-pressure inlets comprises a fluid passage configured to independently direct the low-pressure fluid from the fluid source to the low-pressure monobore conduit.

19. The fluid conduit assembly of claim 18, wherein at least one first low-pressure inlet of the plurality of low-pressure inlets is positioned on a first side of the low-pressure monobore conduit, and at least one second low-pressure inlet of the plurality of low-pressure inlets is positioned on a second side of the low-pressure monobore conduit, opposite the first side.

20. The fluid conduit assembly of claim 19, wherein the at least one first low-pressure inlet comprises a plurality of first low-pressure inlets, the at least one second low-pressure inlet comprises a plurality of second low-pressure inlets.

* * * * *